US009765461B2

(12) United States Patent
Thomson

(10) Patent No.: US 9,765,461 B2
(45) Date of Patent: Sep. 19, 2017

(54) PORTABLE WASHING APPARATUS

(71) Applicant: John W Thomson, Oak Harbor, WA (US)

(72) Inventor: John W Thomson, Oak Harbor, WA (US)

( * ) Notice: Subject to any disclaimer, the term of this patent is extended or adjusted under 35 U.S.C. 154(b) by 249 days.

(21) Appl. No.: 14/828,345

(22) Filed: Aug. 17, 2015

(65) Prior Publication Data

US 2015/0354121 A1 Dec. 10, 2015

Related U.S. Application Data

(63) Continuation of application No. 13/541,536, filed on Jul. 3, 2012, now Pat. No. 9,109,316.

(60) Provisional application No. 61/504,873, filed on Jul. 6, 2011.

(51) Int. Cl.

| | |
|---|---|
| ***D06F 5/00*** | (2006.01) |
| ***D06F 5/02*** | (2006.01) |
| ***D06F 5/04*** | (2006.01) |

(52) U.S. Cl.

CPC ..... *D06F 5/04* (2013.01); *D06F 5/00* (2013.01); *D06F 5/02* (2013.01)

(58) Field of Classification Search

None

See application file for complete search history.

(56) References Cited

U.S. PATENT DOCUMENTS

| | | | | |
|---|---|---|---|---|
| 158,039 | A | 12/1874 | Crowell | |
| 162,548 | A | 4/1875 | Hart | |
| 228,010 | A | 5/1880 | Wicklin | |
| 2,124,635 | A | 7/1938 | Schmid | |
| 2,156,541 | A | 5/1939 | Misenhimer et al. | |
| 2,212,559 | A | 8/1940 | Ehret | |
| 2,341,729 | A * | 2/1944 | Lundgren-Jonson | D06F 5/02 68/156 |
| 3,065,621 | A | 11/1962 | Sam | |
| 3,320,779 | A | 5/1967 | Kent | |
| 4,832,066 | A | 5/1989 | Shipman | |
| 4,854,718 | A | 8/1989 | Wang | |
| 5,184,544 | A | 2/1993 | Ling | |
| 5,900,069 | A | 5/1999 | Llerena | |
| 6,086,240 | A | 7/2000 | Murphy | |
| 6,341,508 | B1 | 1/2002 | Minassian | |
| 6,616,318 | B1 | 9/2003 | LeBlanc et al. | |
| 8,025,436 | B2 | 9/2011 | Hensler | |
| 9,109,316 | B1 | 8/2015 | Thomson | |
| 2001/0036124 | A1 | 11/2001 | Rubenstein | |

(Continued)

OTHER PUBLICATIONS

Joseph Enterprises, The Pogo Whisk, http://thepogowhisk.com/, date unknown, 2 pages.

(Continued)

*Primary Examiner* — Michael Barr

*Assistant Examiner* — Rita Adhlakha

(74) *Attorney, Agent, or Firm* — Schacht Law Office, Inc.; Dwayne Rogge

(57) ABSTRACT

This disclosure relates to the field of washing apparatus which are portable, and operable without a running source of water, and without a power source. The washing apparatus operates with a volume of liquid cleaner (water) and manual manipulation of a handle. The apparatus may also be disassembled by a user without tools for shipping or storage in a much smaller space.

15 Claims, 13 Drawing Sheets

(56) References Cited

U.S. PATENT DOCUMENTS

| | | | |
|---|---|---|---|
| 2001/0046180 | A1 | 11/2001 | King et al. |
| 2005/0005655 | A1 | 1/2005 | Taylor |
| 2012/0080062 | A1 | 4/2012 | Parker et al. |

OTHER PUBLICATIONS

Primula, Cold Brew Glass Carafe Brewing System—Iced Coffee Maker, http://primulaproducts.com/coffeeware/coffee-makers/cold-brew-carafe-iced-coffee-cold-brewing, date unknown, 1 page.
Simply Good Stuff, Inc., WonderWash, http://www.simplygoodstuff.com/wonderwash.html, 2006-2015, 17 pages.

* cited by examiner

PORTABLE WASHING APPARATUS

RELATED APPLICATIONS

This application is a continuation claiming priority benefit of U.S. Ser. No. 13/541,536 filed Aug. 8, 2015 and U.S. Ser. No. 61/504,873, filed Jul. 6, 2011 incorporated herein by reference.

BACKGROUND OF THE DISCLOSURE

Field of the Disclosure

This disclosure relates to the field of fabric (i.e. clothes) washing apparatus which are portable, and operable without a running source of water, and without a power source. The washing apparatus operates with a volume of liquid cleaner (water) and manual manipulation of a handle.

SUMMARY OF THE DISCLOSURE

Disclosed herein is a portable washing apparatus for the washing of fabrics. The washing apparatus in one example comprising: a base member configured to fit within a watertight container; a frame extending vertically from and removably attached to the base member; a cross support extending horizontally across the frame and removably attached thereto; and an agitator having a lower end attached to the base member so as to freely rotate thereupon. The agitator having an upper end attached to the cross support so as to freely rotate there under. The washing apparatus may also include a driving portion having a user-engagement handle, a shaft, and an agitator engagement portion. The driving portion may utilize a system of detents and grooves whereupon oscillating vertical movement of the driving portion by the user is translated to rotary movement of the agitator.

In one form, the portable washing apparatus as disclosed is arranged wherein the base member comprises a plurality of identical base portions which are removably connected to each other to form the base member.

The portable washing apparatus may also be arranged wherein the frame comprises a plurality of vertical supports. Each vertical support having a lower end removably attached to the base and an upper end removably attached to an upper ring.

The frame of the portable washing apparatus may comprise: a cross support having a surface defining a non-cylindrical hole therein; wherein the driving portion comprises a non-cylindrical shaft; and wherein the non-cylindrical hole engages the non-cylindrical shaft an prohibits rotation of the driving portion relative to the frame.

The driving portion of the portable washing apparatus as may also comprise at least one detent extending radially therefrom. Wherein the agitator comprises a surface defining a bore; and wherein the bore comprises surfaces defining at least one spiral indent which receive the detents extending radially from the driving portion such that linear oscillation of the driving portion results in rotational movement of the agitator.

The portable washing apparatus also may include at least one spiral indent which is arranged such that linear oscillation of the driving portion results in rotational oscillation of the agitator.

The portable washing apparatus in one form is configured to fit entirely or substantially within a portable fluid container (rigid or collapsible) during operation.

The portable washing apparatus may be formed wherein the base member comprises a plurality of raised portions extending longitudinally therefrom so as to maintain a significant portion of the base member above the lower inner surface of a portable fluid container during operation to function as a dirt trap.

The portable washing apparatus as disclosed may include a plurality of extensions protruding from a longitudinal central member.

The portable washing apparatus may also be arranged wherein the frame comprises a plurality of clamp arms which engage the upper surface of a rigid portable fluid container so as to maintain position of the frame relative to the rigid portable fluid container.

The portable washing apparatus as disclosed may utilize a cover substantially enclosing the apparatus with or without a separate cross member.

The portable washing apparatus as disclosed may utilize a collapsible bag, a rigid bucket, or other fluid container or reservoir. The collapsible bag may be positioned radially within a plurality of vertical supports, or may be positioned external of the vertical supports.

A portable washing apparatus for the washing of fabrics is disclosed. The washing apparatus comprising: a bottom plate configured to fit external of a watertight container; a base member configured to fit within the watertight container; a frame extending vertically from and removably attached to the bottom plate. A cross support may be included, extending horizontally across the frame and removably attached thereto. An agitator having a lower end attached to the base member so as to freely rotate thereupon is positioned within the watertight container. The agitator having an upper end attached to the cross support so as to freely rotate there under. A driving portion having a user-engagement handle, a shaft, and an agitator engagement portion is also included. The driving portion and agitator having a system of detents and grooves whereupon oscillating vertical movement of the driving portion by the user is translated to rotary movement of the agitator.

In one form, the cross member comprises a cover substantially enclosing the apparatus.

In one configuration, the bottom plate comprises a plurality of identical plate components; and the cover comprises a plurality of the identical plate components.

DESCRIPTION OF THE PREFERRED EMBODIMENTS

Figure 1:
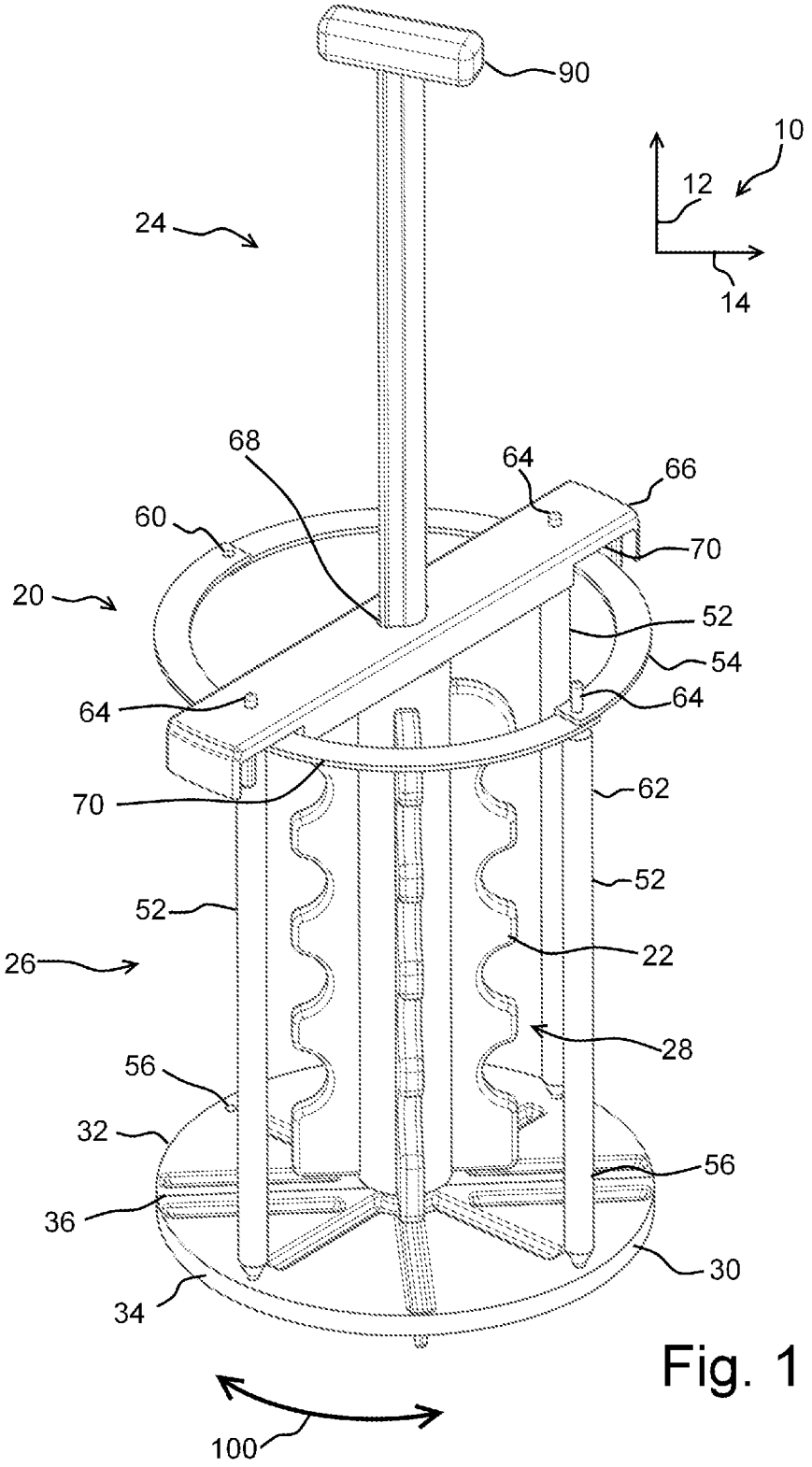
FIG. 1 is an isometric view of the disclosed apparatus in one configuration.

Before beginning a detailed description, an axes system 10 is shown in FIG. 1 comprising a vertical axis 12, and a radial axis 14 which is centered upon the center of the long axis of the agitator component 22 and is directed radially outward. This axes system is intended to aid in description of the disclosed apparatus and is not intended to be limiting.

Looking again to FIG. 1, one configuration of a portable washing apparatus 20 is shown. The portable washing apparatus 20 generally comprises three independent but interoperating portions: a driving portion 24, a frame portion 26, and an agitator portion 28. Each of these portions are assembled together for a washing device which does not require running water to operate, and also does not require a power source such as wind, hydro, electric, or other outside power sources. While the apparatus may be mechanized, it operates well with a user (human) simply filling the machine with a cleaning fluid and then manipulating the handle.

Figure 2:
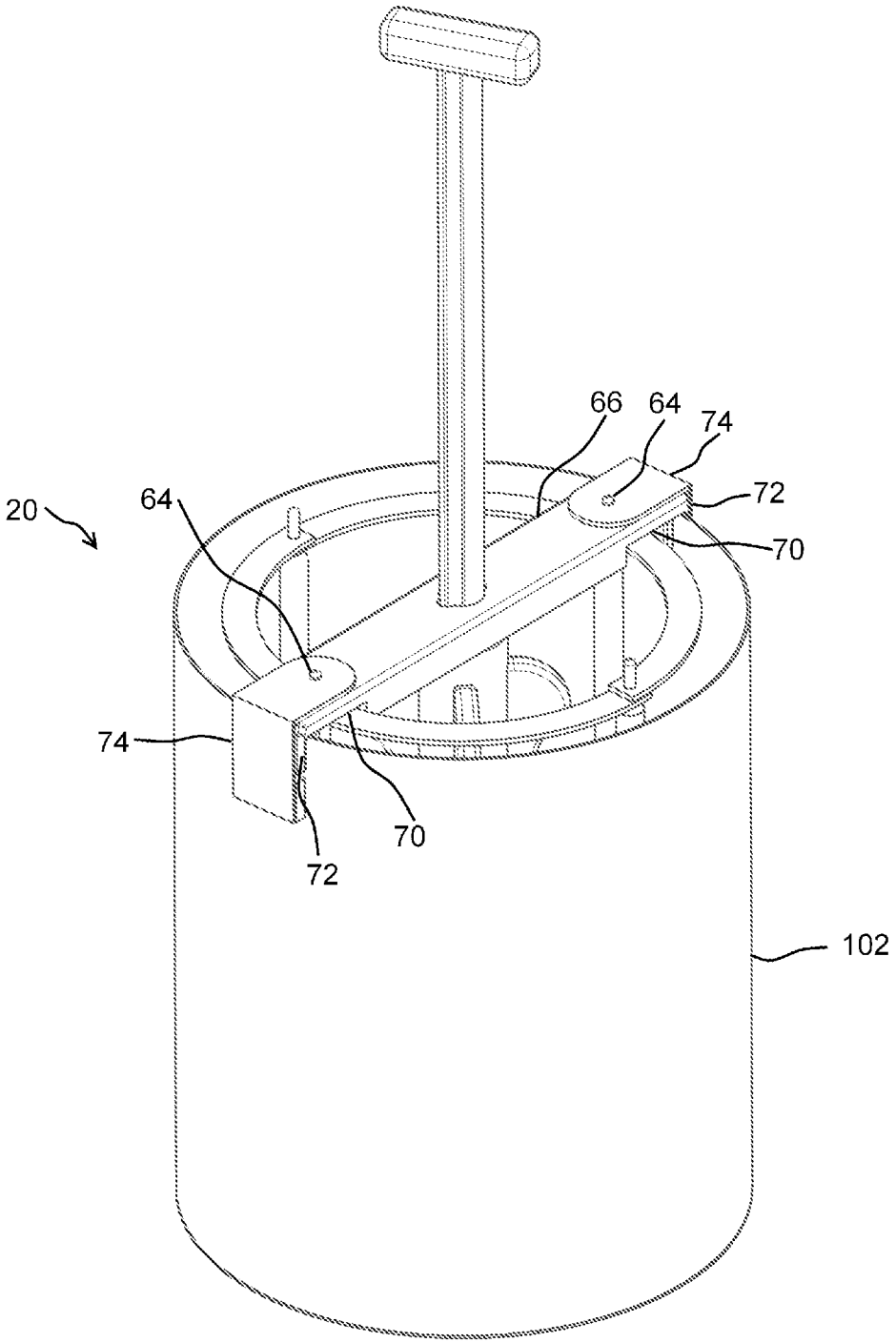
FIG. 2 is an isometric view of the apparatus of FIG. 1 within a container.

Looking to FIG. 2, the apparatus is configured wherein a fluid holding container 102 is also provided. The container 102 in this configuration surrounds the frame portion 26, and agitator portion 28. In another configuration, the container 102 may be provided between the frame portion 28 and agitator portion 28. This fluid container 102 may be a rigid element such as a bucket, barrel, or similar apparatus, or may be a flexible container such as for example a bag. Collapsible buckets may be especially useful as they are easily collapsed and thus take up less space for shipping or storage.

Returning to FIG. 1, the frame portion generally comprises a base 30 which in one form comprises a first portion 32 and second portion 34 with a seam 36 therebetween. The configuration of these portions can be more easily seen in FIGS. 9 and 10 where it can be seen that to reduce manufacturing and replacement costs, the first portion 32 and second portion 34 may be formed as identical components. By using the illustrated semicircular portions, interconnected by way of a plurality of surfaces defining holes 38 and interoperating detents 40 a single molded component can form both of these first and second portions 32/34. In addition, the bottom side 42 may comprise a plurality of raised portions 44 providing a fluid gap between the base 30 and the lower inner surface of the container 30 to increase the cleaning action of the apparatus. Additionally, a plurality of channels 46 may be formed in the upper surface 48 of the base 30 to further increase cleaning action, as well as provide additional rigidity and support to the overall apparatus. In one form, the raised portions 44 fit within channels 46 to improve stackability of the apparatus. In the drawings, the mating surface 50 between individual components is planar, although other shapes could alternatively be utilized.

Figure 3:
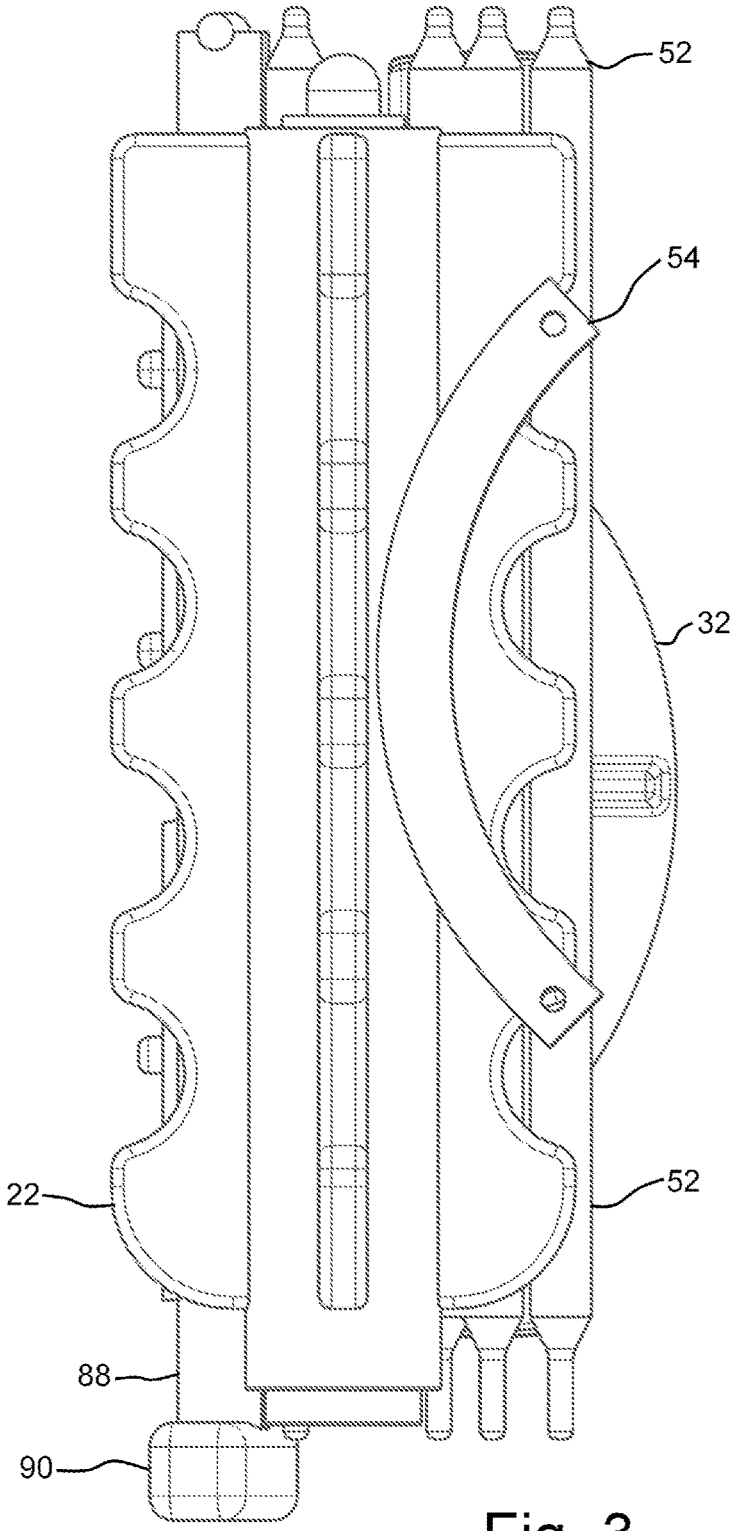
FIG. 3 is a plan view of the apparatus of FIG. 1 in a disassembled configuration.
Figure 4:
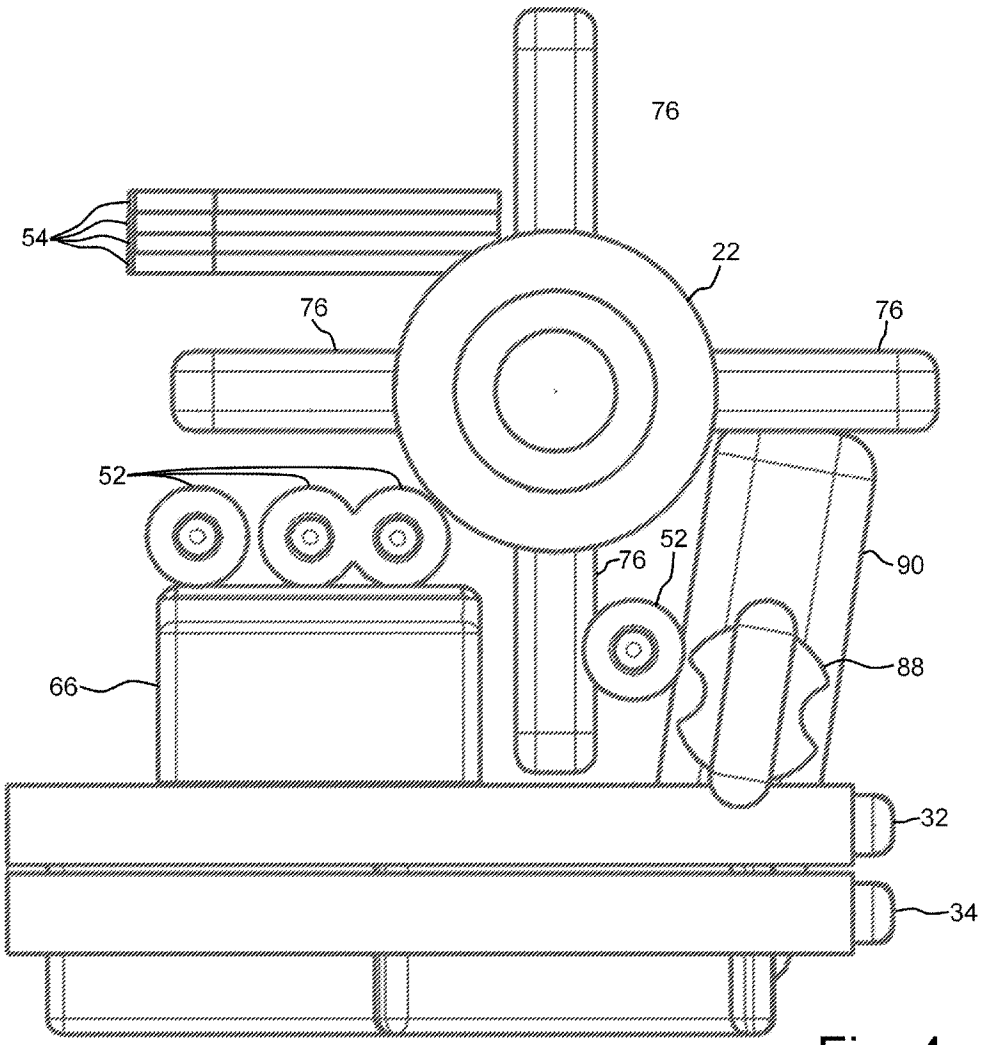
FIG. 4 is an end view of the configuration of FIG. 3.

A plurality of vertical supports 52 may be provided as shown in FIGS. 1, 3, and 4 which provide vertical separation between the base 30 and an upper ring 54. One of the vertical supports is not shown in FIG. 1, so that the surfaces defining holes 58 and 60 can more clearly be seen. The upper ring 54 may also be comprised of separate and interconnecting components. In the drawings, the components are semicircular, but other shapes may also be used. In one configuration, the lower end 56 of the vertical supports 52 fits into one of several surfaces defining holes 58 in the base 30. These surfaces defining holes 58 may also be seen in FIGS. 9 and 10. In FIG. 1, one of the vertical supports 52 is removed to show the holes 58 in the base 30, as well as one of several holes 60 in the upper ring 54.

In one configuration, the upper end 62 of the vertical supports 52 comprises a pin 64 to interconnect the individual components of the upper ring 54, and maintain relative position between the upper ring 54 and the vertical supports 52.

Figure 11:
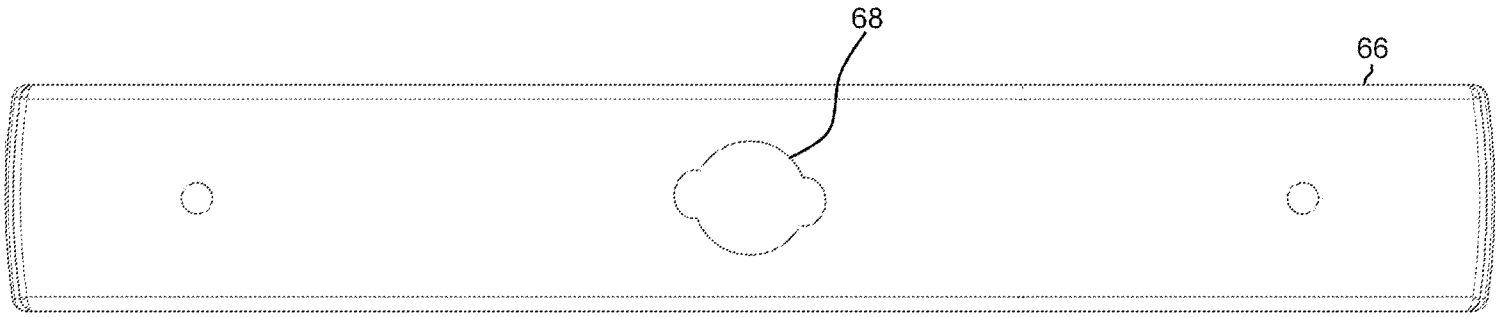
FIG. 11 is a top (plan) view of a cross member component of the disclosed apparatus.
Figure 12:
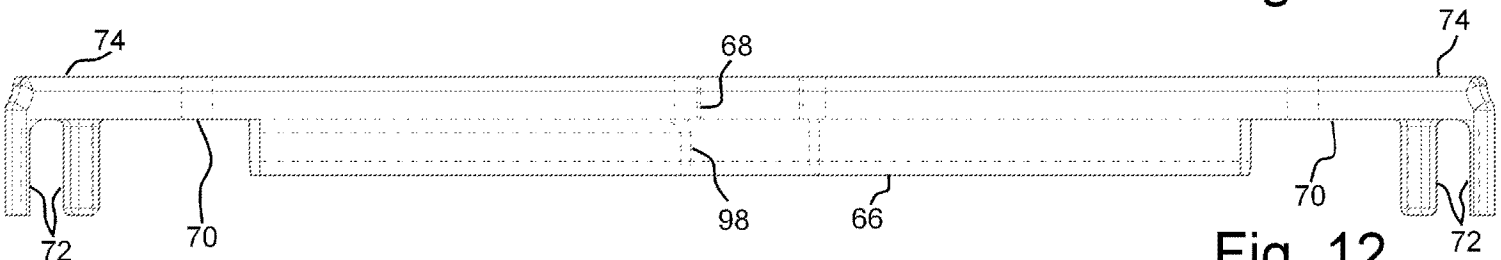
FIG. 12 is a side hidden line view of the cross member component shown in FIG. 11.
Figure 13:
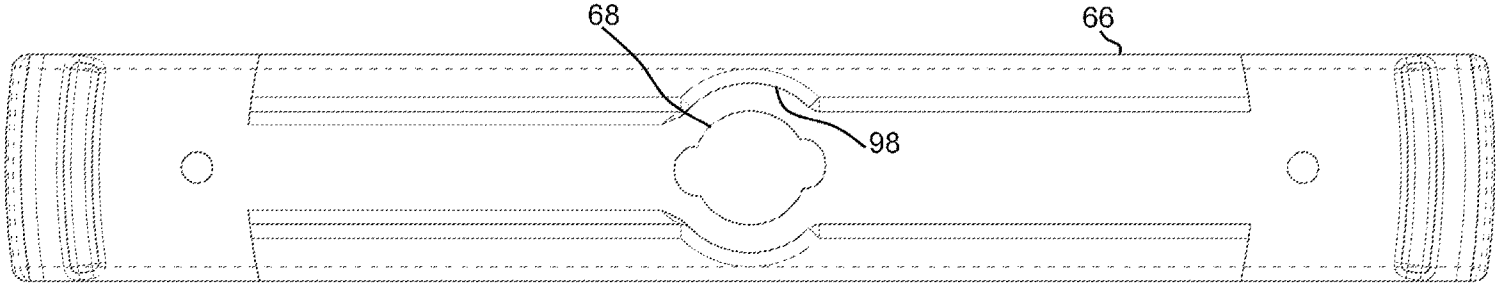
FIG. 13 is a bottom hidden line view of the cross member component shown in FIG. 11.

In one configuration, a cross support 66 is utilized as shown in FIGS. 1 and 2 comprising a surface defining a central void 68 for receiving of the driving portion 24. In FIGS. 11-13 it can be seen how in this embodiment, the void 68 is non-circular so as to prohibit rotation of the driving portion 24 relative to the cross support 66.

In one configuration, the cross support 66 comprises recesses 70 for maintaining proper position upon the upper ring 54, as well as surfaces 72 for maintaining the apparatus 20 in relative position to the container 30. In one form as shown in FIG. 2, the cross support 66 comprises clamp arms 74 which further hold the container 30 in position relative to the cross support 66. In this embodiment, both the cross support 66 and clamp arms 74 are also held in position by the pins 64 on to which they are pressed.

In one form, a collapsible bag 108 may be utilized which fits over the apparatus and comprises grommets 110, holes, strings, etc. which fit over the pins 64. The upper ring 54 is then installed over the grommets, and this assembly holds the bag in place. In another form, the bag may fit within the vertical supports 52 in the same manner.

Figure 5:
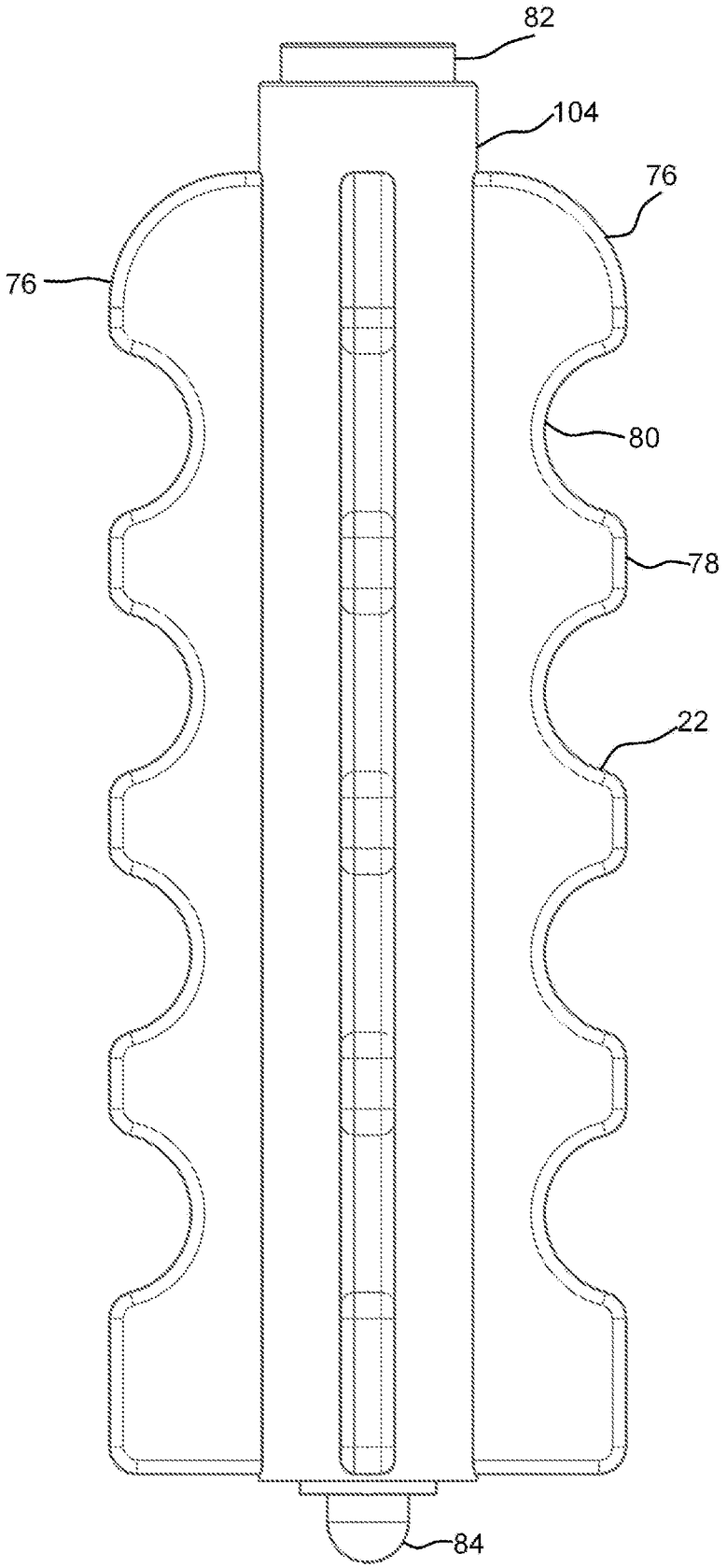
FIG. 5 is a side view of an agitator component of the apparatus of FIG. 1.
Figure 6:
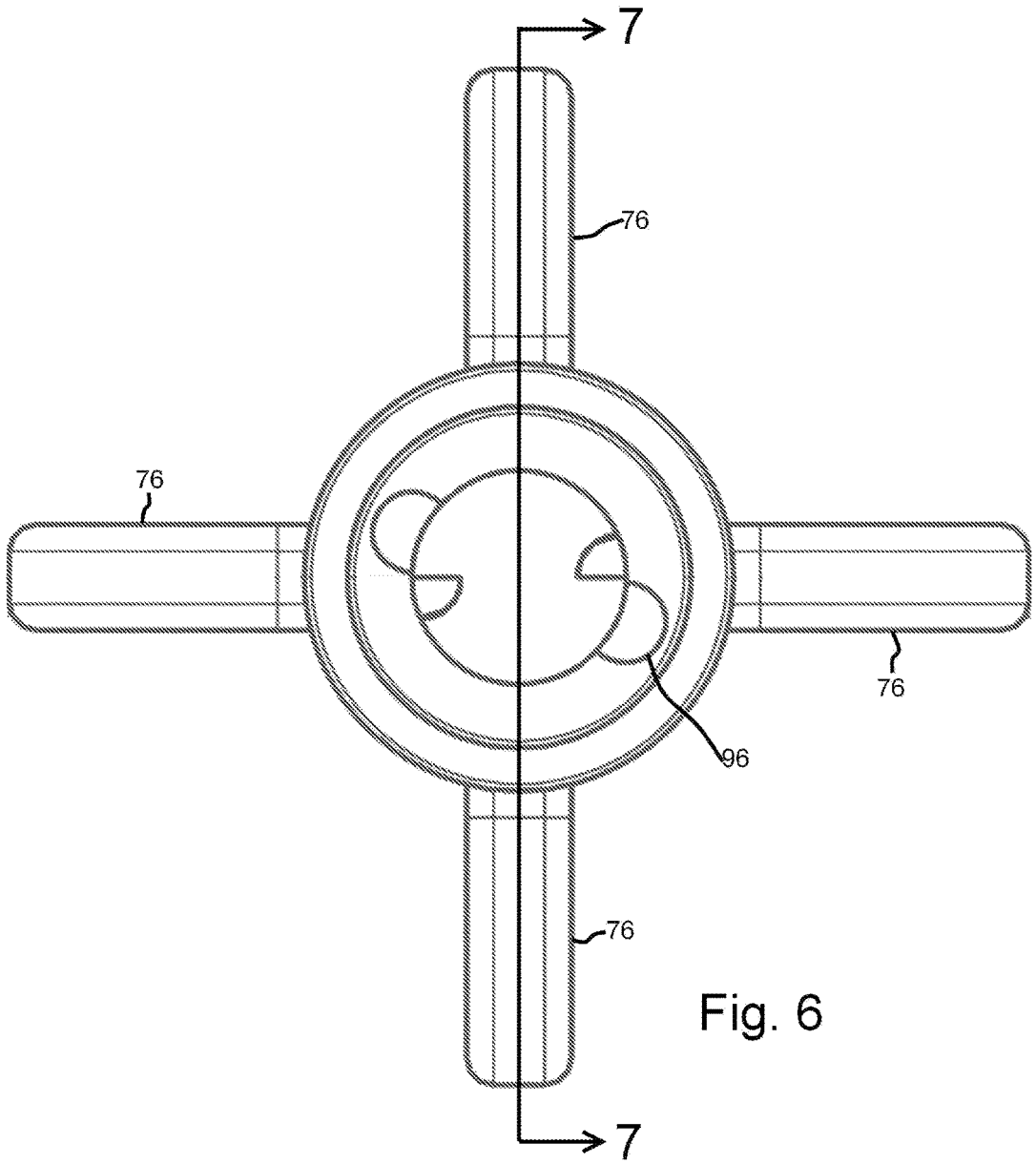
FIG. 6 is an end view of the component of FIG. 5.
Figure 7:
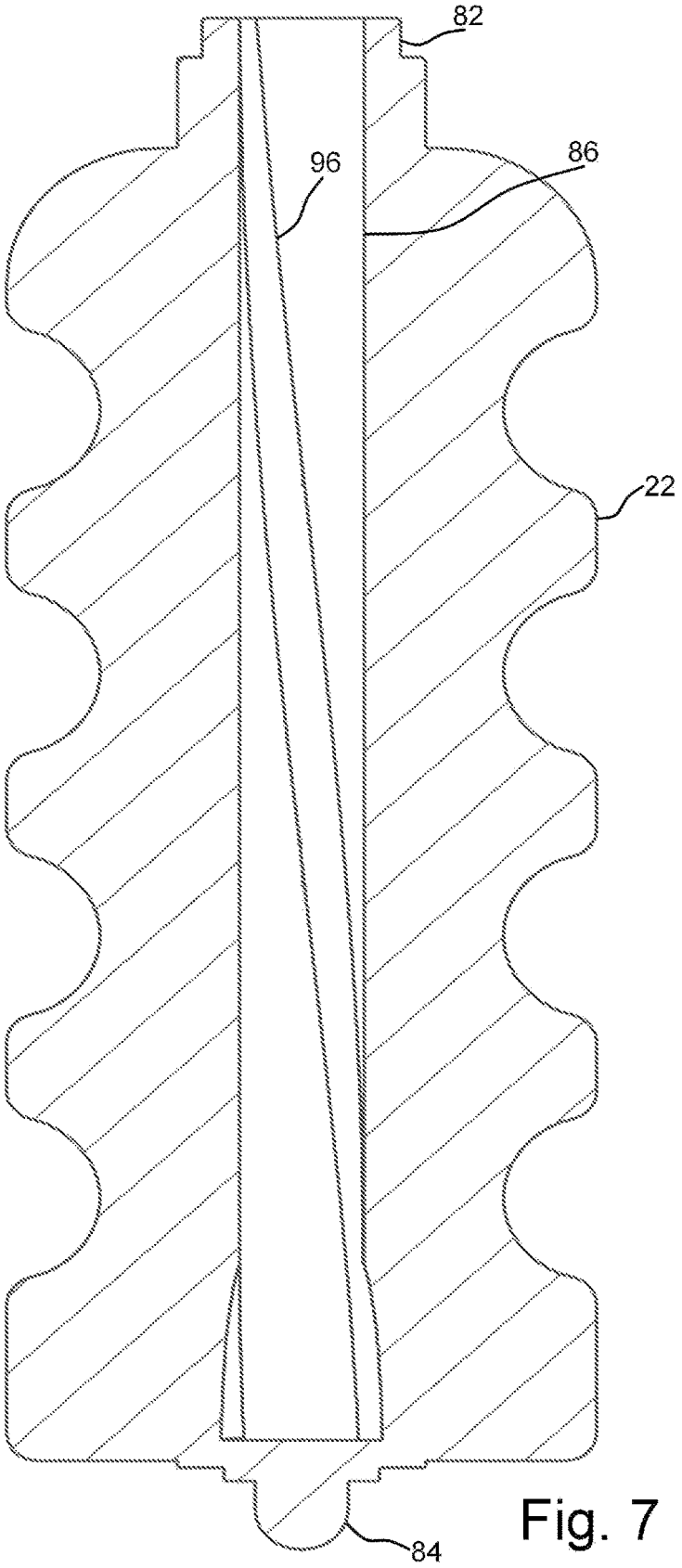
FIG. 7 is a side cutaway view of the component of FIG. 6 taken along line 7-7.
Figure 9:
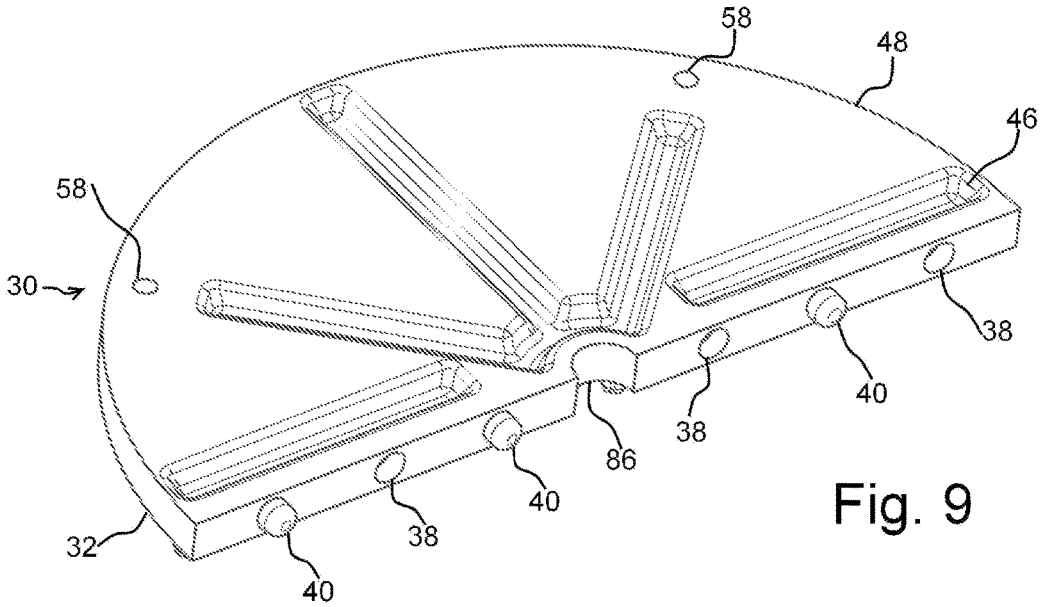
FIG. 9 is an isometric view of the top side of a split base component of the apparatus of FIG. 1.
Figure 10:
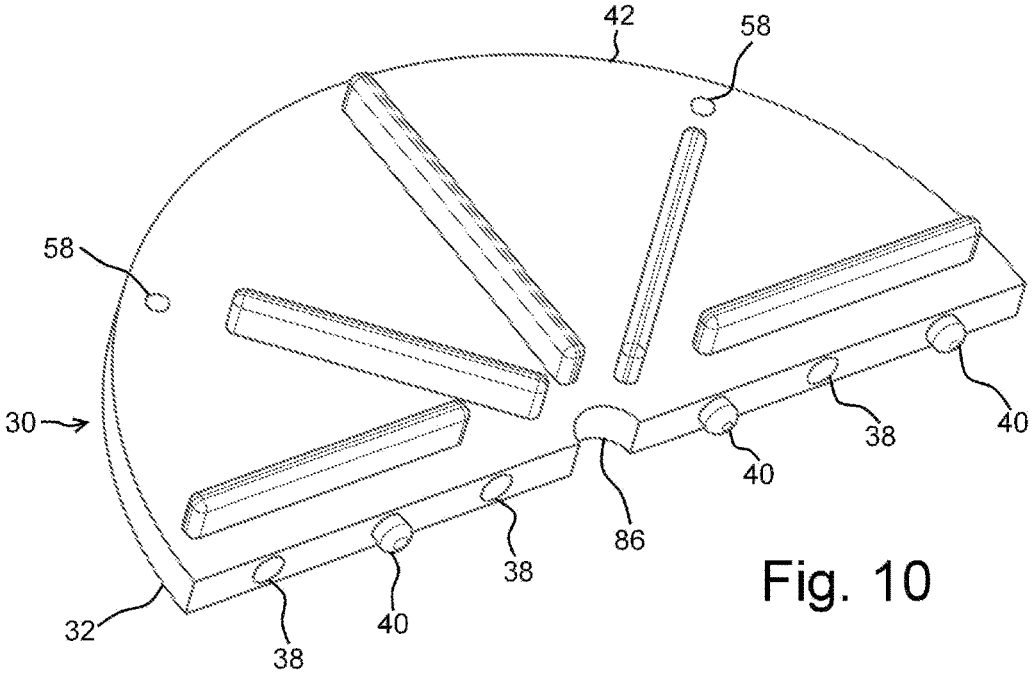
FIG. 10 is an isometric view of the bottom side of the component of FIG. 9.

Looking to FIG. 5, a detail view of the agitator 22 in one configuration is shown. While this configuration comprises a plurality of four extensions 76 (three of which can be seen in this figure) and each extension 76 comprises hills 78 and valleys 80. Each of the extensions 76 being attached to or formed as extensions of a central member 104. The particular arrangement of these surfaces is not critical as many different configurations could be utilized for aesthetic or functional purposes. An end view of the four arm embodiment, is shown in FIG. 4. As shown in FIG. 5, a recess 82 is provided in the upper end of the agitator 22 which fits upon a matching surface 98 of the cross support 66 as can be seen in FIGS. 12 and 13. Additionally, on the other vertical end, a bearing 84 is provided which fits within and revolves upon a surface 86 defining a bore or bearing surface as shown in FIGS. 9 and 10. This bearing 84 as shown in FIG. 7 may also provide a cap to prohibit pumping action of cleaning water through the center 86 of the agitator 22 during operation. These surfaces 82/84 at the upper and lower vertical ends of the agitator 22 maintain the agitator 22 in relative position to the other components or portions of the apparatus 20 as it is being rotated (actuated).

Figure 8:
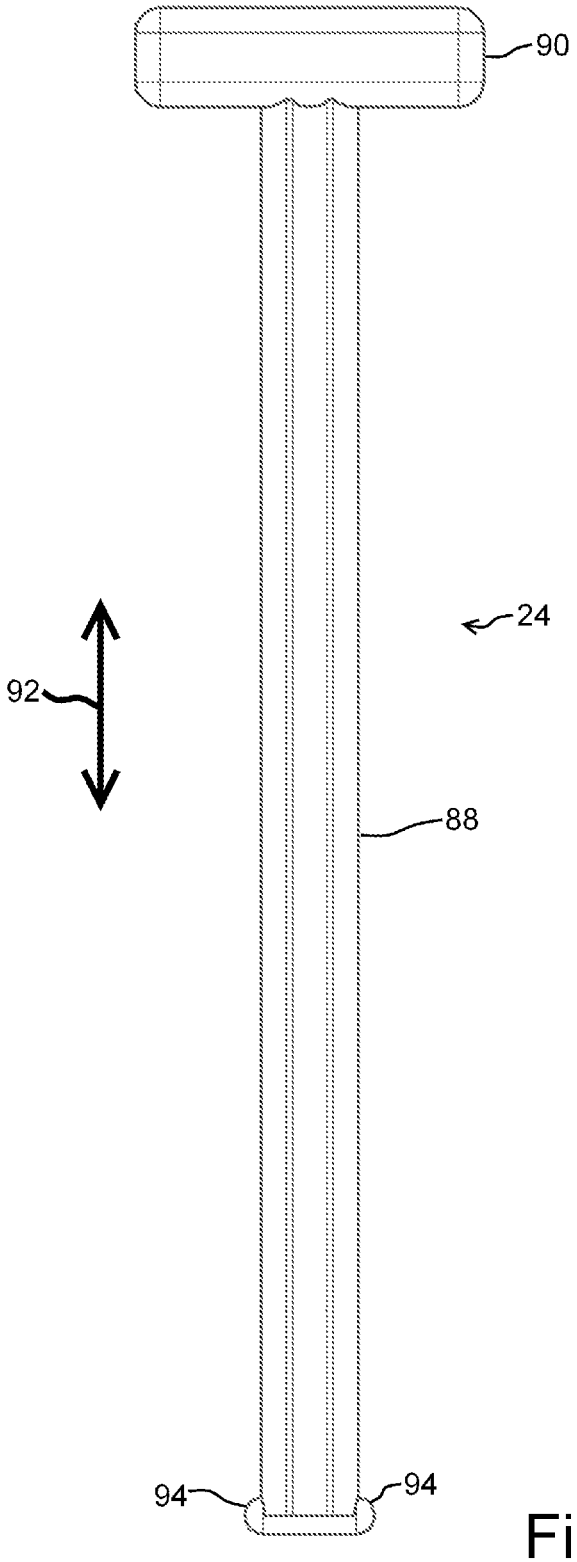
FIG. 8 is a side view of an operating handle component of the apparatus of FIG. 1.

Looking to FIG. 7, a cross sectional view of this configuration of the agitator 22 is shown wherein the inner surface 86 of the agitator 22 is configured to receive detents extending from the driving portion 24. In particular, looking to FIG. 8 it can be seen how the driving portion 24 comprises a shaft 88 which may be non-cylindrical, and a handle 90 which is configured to be grasped by the user while being moved (actuated) in an oscillating vertical motion as shown by the arrow 92. Non-cylindrical being defined herein as a longitudinal extrusion of a geometric shape, wherein the geometric shape is not a circle. At the lower end of the driving portion 24, a plurality of detents 94 may be provided which are configured to engage a plurality of helical "rifling" channels 96 formed within the inner surface 86 of the agitator 22 as seen in FIG. 7. In this embodiment, the cross support 66 as already described does not permit relative rotation of the driving portion 24, and also does not permit vertical movement of the agitator 22. Thus, as the handle 90 is oscillated vertically, the detents 94 rotate the agitator 22 back and forth in direction of travel 100 shown in FIG. 1 as can be understood by one of ordinary skill in the art.

In an alternate configuration, the components are reversed such that the shaft 88 comprises the helical rifling portion, and the engaging surface of the agitator 22 is linear. Other mechanisms such as a system of gears may be utilized instead of the helical rifling portion.

In yet another alternate configuration, the detents may be formed in a spiral shape and engage grooves in the opposing component.

Looking to FIGS. 3 and 4, it can be seen how the entire apparatus can be disassembled into its component parts easily, and in some configurations without tools. This makes the apparatus particularly useful where shipping and/or storage is difficult, while backpacking, and in other environments where more industrialized ways of cleaning clothing are commonplace.

Figure 14:
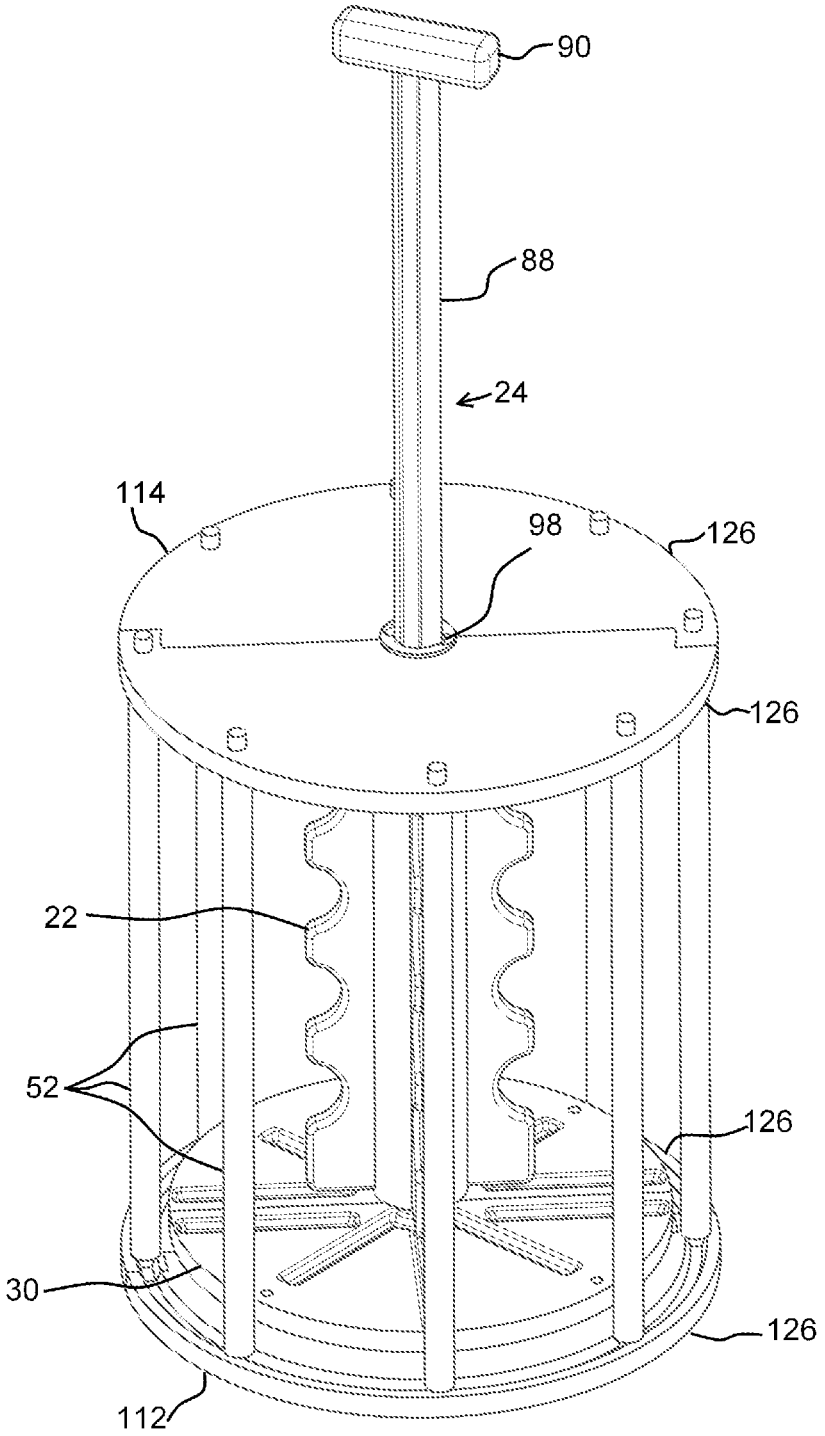
FIG. 14 is an isometric view of the disclosed apparatus with a top cover and additional bottom plate.
Figure 15:
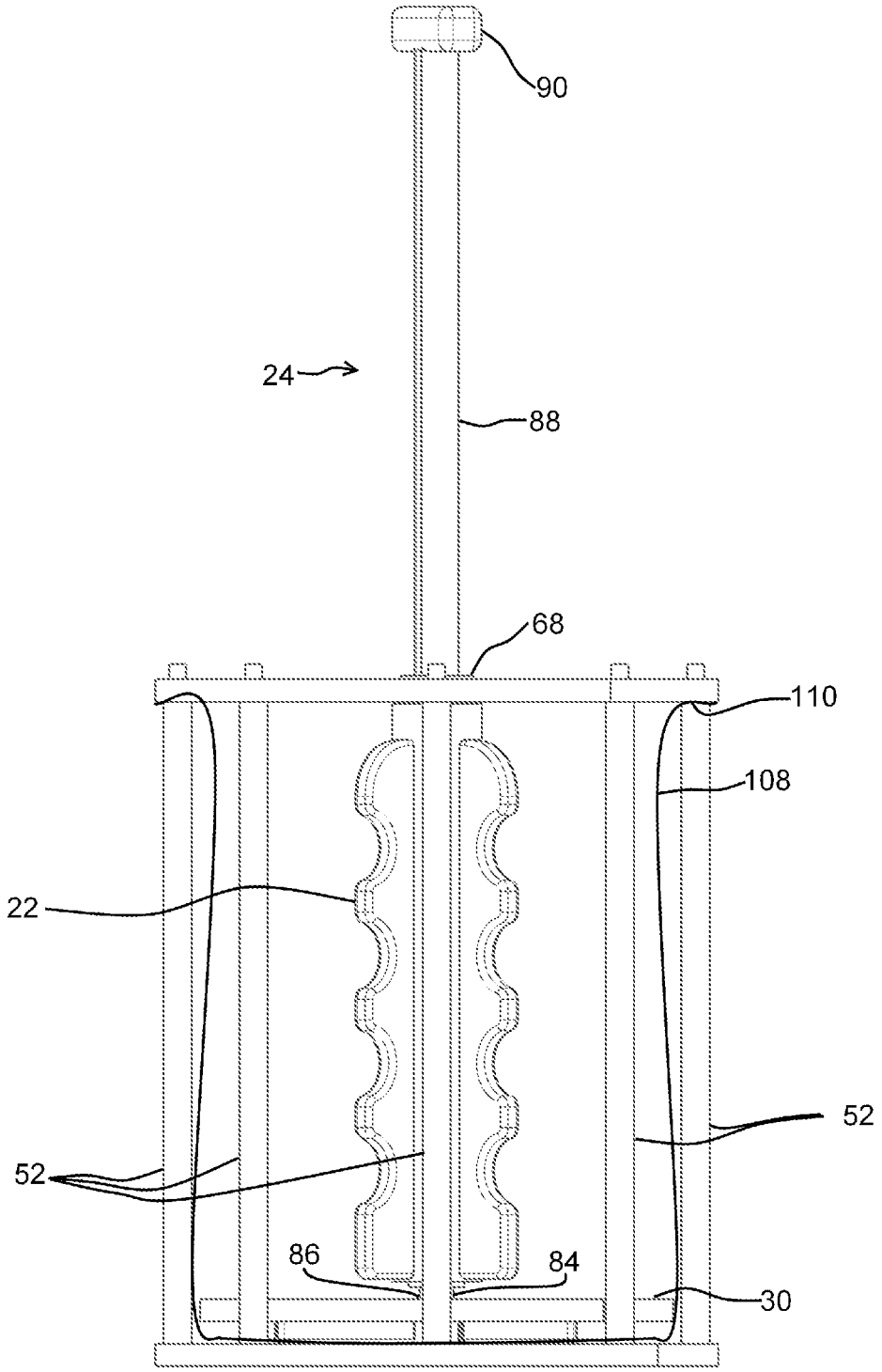
FIG. 15 is a front view of the apparatus as shown in FIG. 14.

FIGS. 14-15 show a configuration wherein a bottom plate and top cover 114 are provided. The bottom plate 112 is placed under the base member 30 and the top cover 114 may operate with a cross member similar to that shown in FIGS. 11-13 or may serve the same function. As shown, a bag 108 is provided and places radially inward of the supports 52 and external of the base member 30 and agitator 22. Again, the bag 108 may have grommets 110 or similar fasteners to attach to the upper end of the frame, such as at the upper end of the supports 52.

Figure 16:
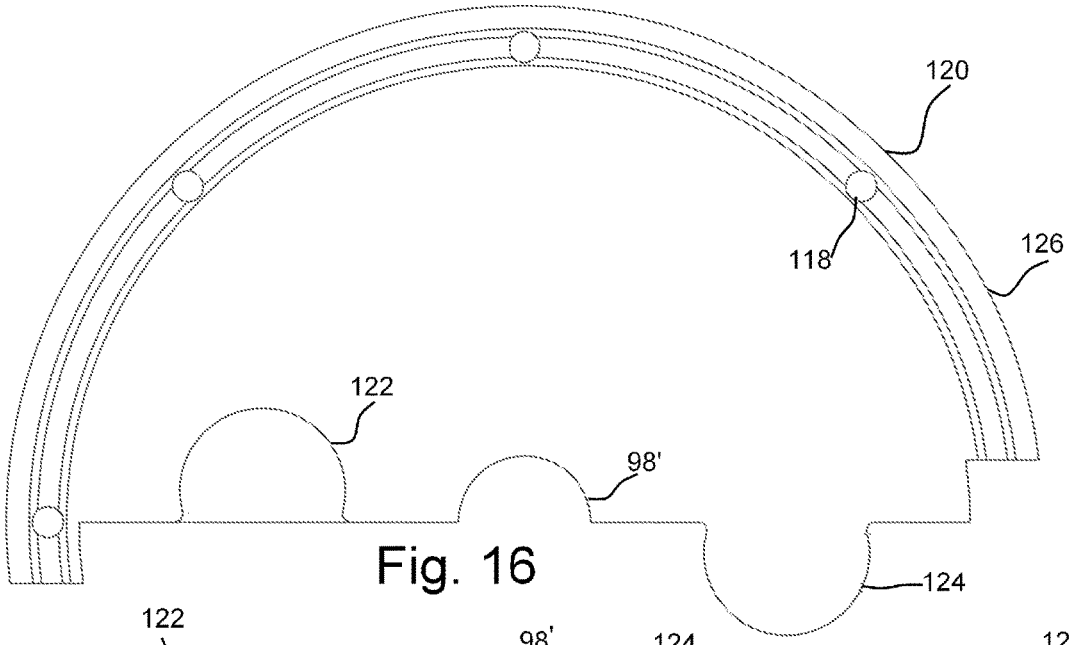
FIG. 16 is a first vertical view of a plate component of the disclosed apparatus.
Figure 17:
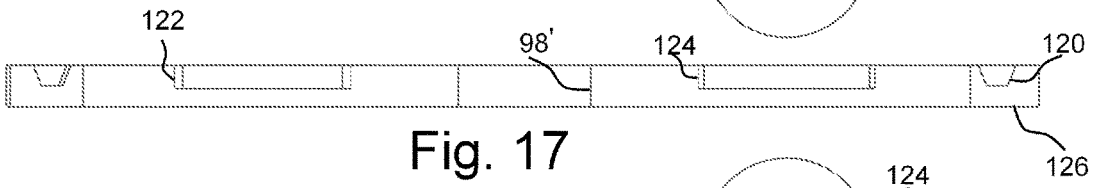
FIG. 17 is a side view of the plate component shown in FIG. 16.
Figure 18:
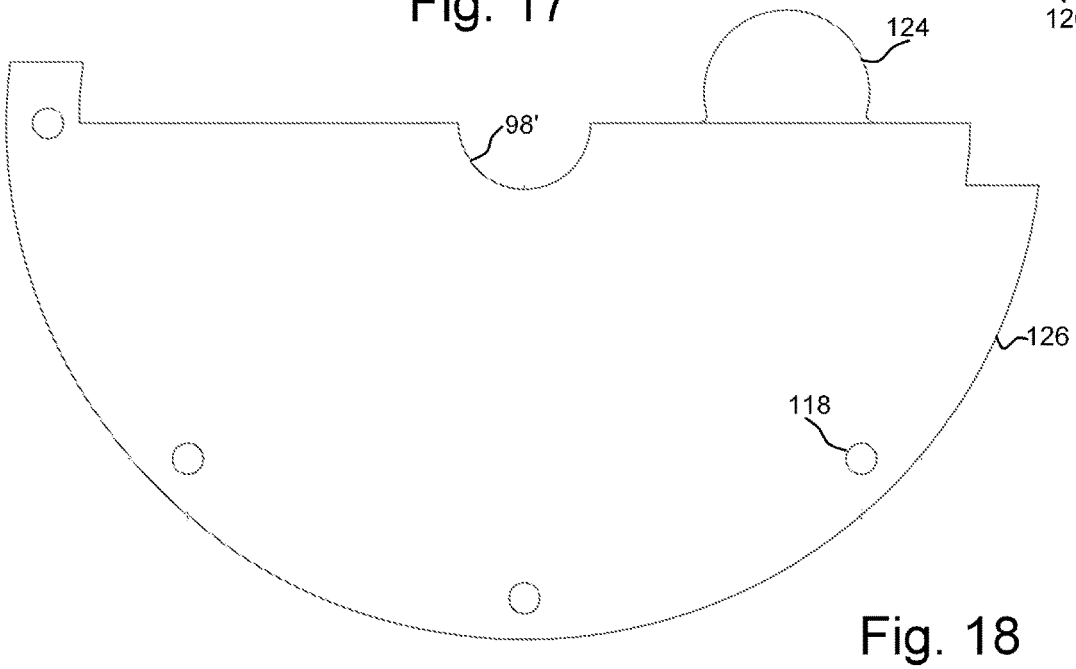
FIG. 18 is a second vertical view of the plate component shown in FIG. 16.

FIGS. 16-18 show one example of the disclosed cover 114 and bottom plate 112 which again may be formed of a single cast. For example a plurality of the plate components 126 may be provided wherein a single cast component forms both sides of each of the cover 114 and bottom plate 112. In this example, the surface 98' functions in the same way as the surface 98 previously disclosed. A plurality of holes 118' are provided for attachment to either the upper or lower end of the supports 52. A groove 120 is provided to assist in alignment of the supports 52 during assembly. Groove 120 also serves as a lip to fit over the outer edge of solid containers and to minimize splashing of water outside of the container while operating the handle. The groove may also be shaped to snap lock onto the side of a solid container such as a lid for a standard 5 gallon bucket. Each plate component 126 in this example also comprises a recess 122 and a projection 124 which engage opposing surfaces of an adjacent component 126 to form the bottom plate 112 or top cover 114.

One added benefit of this example is the ease in which a component may e replaced. As several identical supports 52, several identical plates 126, and several identical base portions 32 are used in each assembly, there are fewer unique parts. A single replacement plate 126 may be used to replace one of the four plates used in this example if broken or damaged.

One form of assembling this example is to assemble the bottom plate 112 by connecting two plate components 126 with the grove side up, then attaching a number of the supports 52 to the bottom plate. The bag 108 may then be positioned within the supports 52 and attached at the top thereof. The base member 30 may then be assembled and placed into the bag 108. The agitator 22 and driver 24 may then be attached to the base member 30. The bag 108 may then be filled with cleaning fluid and fabric (i.e. clothes). The cover 114 may then be assembled about the shaft 88 and attached to the upper end of the supports 52. As previously mentioned, the handle 90 may then be manipulated to rotate the agitator 22 and clean the fabric.

In one form, each of the components could be made of plastics or plastic equivalents to reduce in cost, or alternatively could be made of metals or natural materials where such materials are more plentiful and replacement parts are easier to manufacture when made of these materials. Generally, ease of manufacture by casting has been taken into account, and the majority of the parts can easily and cheaply be cast either in plastics, metals, or other such materials.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

Therefore I claim:

1. A portable washing apparatus comprising:

a. a watertight container;

b. a cross support extending horizontally across the watertight container;

c. an agitator having an upper end attached to the cross support so as to rotate there under, wherein the agitator does not move vertically relative to the watertight container;

d. a driving portion having a user-engagement handle, a shaft, and an agitator engagement portion; and e. a system of detents and grooves whereupon vertical movement of the driving portion by the user is translated to rotary movement of the agitator in a first rotational direction when the driving portion is moved in a first vertical direction and in a second opposing rotational direction when the driving portion is moved in a second opposing vertical direction.

2. The portable washing apparatus as recited in claim 1 further comprising a frame wherein the frame comprises a plurality of vertical supports each having an upper end removably attached to an upper ring.

3. The portable washing apparatus as recited in claim 2 wherein the frame comprises:

a. the cross support having a surface defining a non-cylindrical hole therein;

b. wherein the driving portion comprises a non-cylindrical shaft; and c. wherein the non-cylindrical hole engages the non-cylindrical shaft an prohibits rotation of the driving portion relative to the frame.

4. The portable washing apparatus as recited in claim 1 wherein:

a. the driving portion comprises at least one detent extending radially therefrom;

b. the wherein the agitator comprises a surface defining a bore; and c. wherein the bore comprises surfaces defining at least one spiral indent which receive the detents extending radially from the driving portion such that linear oscillation of the driving portion results in rotational movement of the agitator.

5. The portable washing apparatus as recited in claim 1 wherein the system of grooves comprises at least one spiral indent arranged such that linear oscillation of the driving portion results in rotational oscillation of the agitator.

6. The portable washing apparatus as recited in claim 1 which is configured to fit within a portable fluid container during operation.

7. The portable washing apparatus as recited in claim 1 further comprising a base member wherein the base member comprises a plurality of raised portions extending longitudinally therefrom so as to maintain a significant portion of the base member above an lower inner surface of a portable fluid container during operation to function as a dirt trap.

8. The portable washing apparatus as recited in claim 1 wherein the agitator comprises a plurality of extensions protruding from a longitudinal central member.

9. The portable washing apparatus as recited in claim 1 further comprising a frame wherein the frame comprises a plurality of clamp arms which engage the upper surface of a rigid portable fluid container so as to maintain position of the frame relative to the rigid portable fluid container.

10. The portable washing apparatus as recited in claim 1 wherein the cross member comprises a cover substantially enclosing the apparatus.

11. The portable washing apparatus as recited in claim 1 further comprising a collapsible bag.

12. The portable washing apparatus as recited in claim 11 wherein the collapsible bag is positioned radially within a plurality of vertical supports.

13. A portable washing apparatus for the washing of fabrics, the washing apparatus comprising:

a. a bottom plate configured to fit external of a watertight container;

b. a frame extending vertically from and removably attached to the bottom plate;

c. a cross support extending horizontally across the frame and removably attached thereto;

d. an agitator;

e. the agitator having an upper end attached to the cross support;

f. a driving portion having a user-engagement handle, a shaft, and an agitator engagement portion; and g. a system whereupon vertical movement of the driving portion by the user is translated to rotary movement of the agitator in a first rotational direction when the driving portion is moved in a first vertical direction and in a second opposing rotational direction when the driving portion is moved in a second opposing vertical direction.

14. The portable washing apparatus as recited in claim 13 wherein the cross member comprises a cover substantially enclosing the apparatus.

15. The portable washing apparatus as recited in claim 14 wherein:

a. the bottom plate comprises a plurality of identical plate components; and b. the cover comprises a plurality of the identical plate components.

* * * * *